US006608908B1

(12) United States Patent
Galet et al.

(10) Patent No.: US 6,608,908 B1
(45) Date of Patent: Aug. 19, 2003

(54) ELECTROACOUSTIC COMMUNICATION DEVICE FOR USE ON PROTECTIVE HEADGEAR

(75) Inventors: Adrien Galet, Chatillon-sur-Chalaronne (FR); Bernard Maden, Peronnas (FR)

(73) Assignee: Gallet SA, Chatillon-sur-Chalaronne (FR)

( * ) Notice: Subject to any disclaimer, the term of this patent is extended or adjusted under 35 U.S.C. 154(b) by 0 days.

(21) Appl. No.: 09/101,601

(22) PCT Filed: Jan. 9, 1997

(86) PCT No.: PCT/FR97/00041

§ 371 (c)(1),
(2), (4) Date: Sep. 14, 1998

(87) PCT Pub. No.: WO97/25832

PCT Pub. Date: Jul. 17, 1997

(30) Foreign Application Priority Data

Jan. 12, 1996 (FR) ..... 96 00459

(51) Int. Cl.[7] ..... H04R 25/00

(52) U.S. Cl. ..... 381/376; 381/370; 381/375; 379/430; 455/351

(58) Field of Search ..... 381/361, 367, 381/376, FOR 148; 2/209, 906; 379/430; 455/90, 351

(56) References Cited

U.S. PATENT DOCUMENTS

| | | | | |
|---|---|---|---|---|
| 4,152,553 A | 5/1979 | White | ..... | 179/156 R |
| 5,404,577 A | 4/1995 | Zuckerman et al. | ..... | 455/66 |

FOREIGN PATENT DOCUMENTS

| | | |
|---|---|---|
| EP | 019 838 B1 | 1/1984 |
| EP | 038 430 B1 | 11/1984 |

*Primary Examiner*—Huyen Le
(74) *Attorney, Agent, or Firm*—Fay, Sharpe, Fagan, Minnich & McKee, LLP

(57) ABSTRACT

An electroacoustic communication device (1) including a sensor, e.g. a microphone, and an earphone, and, suitable for use on protective headgear (30). The sensor and the earphone are arranged in a housing (4) and connecting means are provided for attaching the housing (4) to the headgear (30).

10 Claims, 5 Drawing Sheets

ELECTROACOUSTIC COMMUNICATION DEVICE FOR USE ON PROTECTIVE HEADGEAR

BACKGROUND OF THE INVENTION

The present invention concerns an electro-acoustic communication device and, more specifically, protective headgear like a helmet equipped with such device.

Protective headgear has been used for quite some time in various fields, either in a professional capacity, as is the case with respect to the military, the police or the firemen, or for private or personal use, as is the case with respect to motorbikes, rally or racing vehicles. Also known are helmets which are equipped with a communication means, permitting its user to communicate with another user wearing a similar headgear. In this respect, helmets may be cited in French Patents No. 2 289 072, No. 2 502 372 or even No. 2 471 112, which are equipped with rather complicated and not very satisfactory electro-acoustic devices. In fact, the headgear as described in prior art cannot be worn under difficult wearing conditions, for example by the firemen who undertake precarious interventions. An improvement was already proposed which is described in the French Patent Application No. 2 565 057 filed by applicant, according to which the connection between headgear and the electro-acoustic device is removable, while the sensor is an osteo-microphone, carried on one arm. In that same application another electro-acoustic device is proposed, whose connection with the headgear is also removable, but according to which the sensor is a simple microphone, carried on one arm.

However, all these known devices hold a certain number of drawbacks and specifically of being obstructive, little used as well as being relatively complex and fragile.

It is the object of the present invention to resolve the aforementioned drawbacks by proposing a new, particularly simple, reliable and practical device.

SUMMARY OF THE INVENTION

In accordance with the present invention, the electro-acoustic type communication device for protective headgear comprises a sensor, such as a microphone, and a receiver where the sensor and the receiver are arranged in a case and a connection attaches the case to the headgear, where the connection is removable.

In a further aspect of the present invention, the case is attached on the inside of the headgear in the zone or area occupied by the ear of the user. The case has an extension forming a connection tab, engaged in a lateral slide, integral with the headgear, having a complementary shape.

Further, the headgear is, for example, of the type comprising a deformable lining, consisting of a retention headband, a deformable partition or similar, The headband is fixed at the headgear by at least the lateral slide holding the communication device, while the lateral slide is integral with a frontal support piece fixed at the principal external shell of the headgear.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components and the various steps and arrangements of steps. The drawings are only for purposes of illustrating a preferred embodiment and are not to be construed as limiting the invention.

DETAILED DESCRIPTION OF THE PREFERRED EMBODIMENTS

Figure 1:
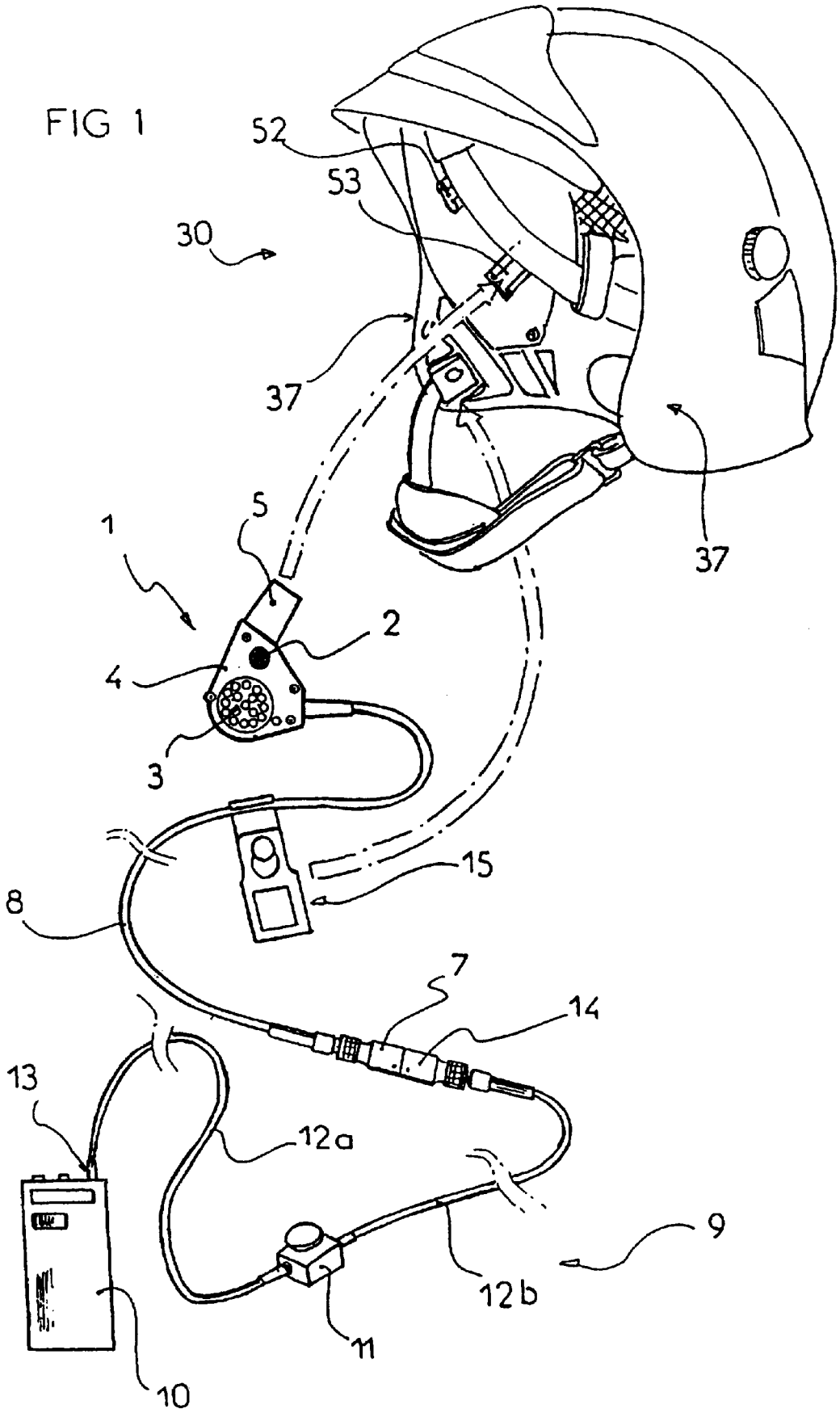
FIG. 1 is a perspective view representing the entire unit of the communication device and an example of the protective headgear for which it is intended.

As seen in FIG. 1, the communication device (1) is of the electro-acoustic type, which emits and/or receives messages permitting the user to communicate with, for example, another user carrying a similar device and comprising a sensor (2) such as a similar microphone and at least one speaker (3).

According to the invention, the device comprises a case (4) in which is arranged,in one area, the speaker (3) and, in another area, the microphone (2). In addition, the case (4) comprises an extension forming a connection tab (5) permitting attachment of the device in a protective headgear.

It should also be added that the speaker (3) and the microphone (2) are joined to a connection (7) by a connection cable (8) which permits connecting the electro-acoustic device to the exterior elements of the equipment (9) known per se which comprise a sender/receiver or transmitter/receiver (10) and a control case (11) arranged between two connection cables **(12*a*, 12*b*), a first electrical cable (12*a*) connected to the sender/receiver (10) thanks to a connection piece (13), and a second electrical cable (12*b*) connected to connection (7) of the device (1) thanks to an automatic safety cut-off (14)**.

In addition, on the connection cable (8) is fixed a hanging device (15) permitting the fixing of said cable (8) in the protective headgear (30) in an appropriate zone.

Figure 2:
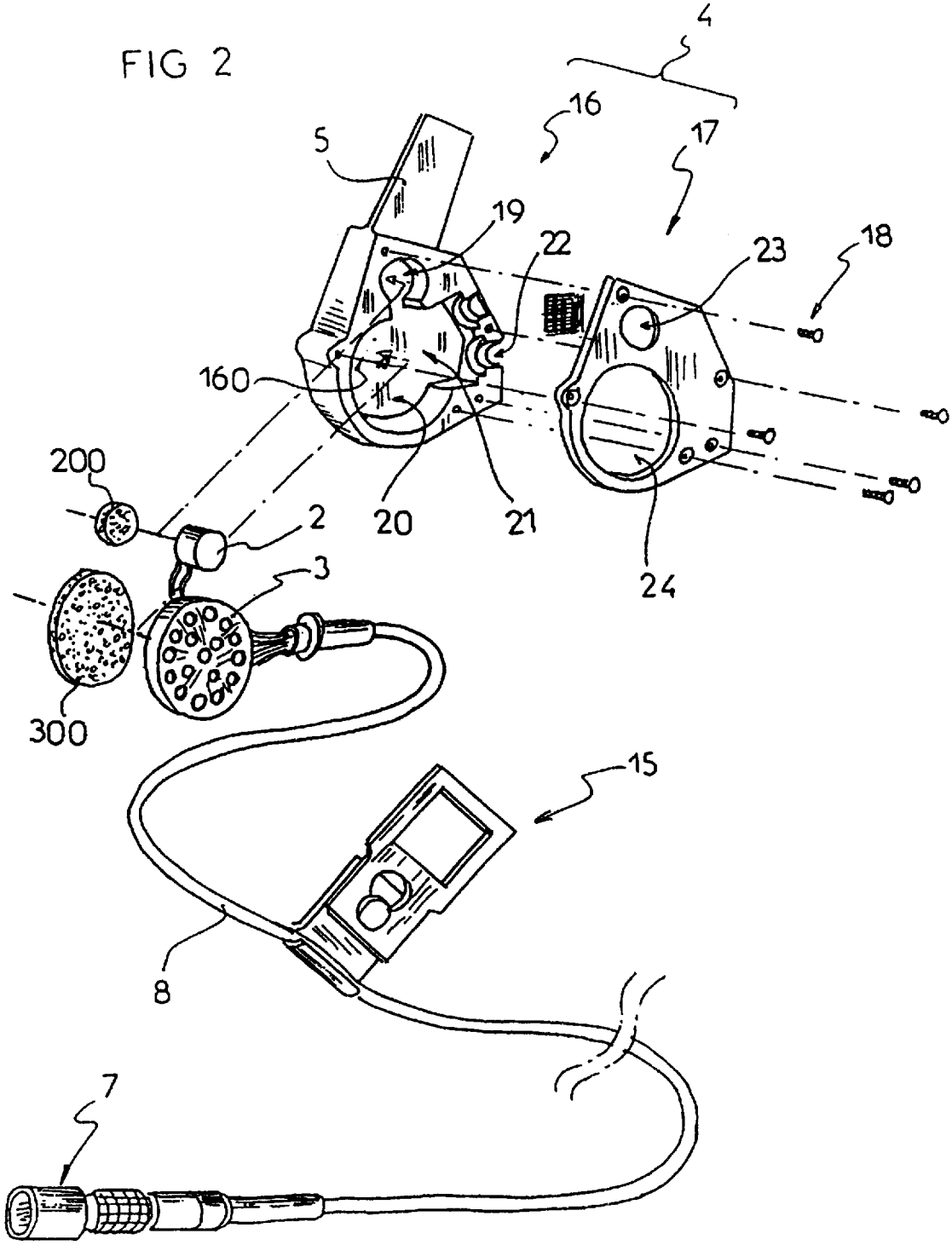
FIG. 2 is an exploded view in perspective, illustrating the different elements constituting the communication device of the invention.

As seen in FIG. 2, the case (4) comprises a case body (16) closed by a cover (17) fixed to said body (16) by clasp or thanks to a screw arrangement (18).

Said body of the case (16) is generally shaped like a triangle and comprises two slots (19, 20), a first cylindrical slot (19) which holds the microphone sensor (2) and a second cylindrical slot (20) of smaller diameter, which holds the speaker (3). In addition, and beneficially, these two slots are connected between each other in order to form a common recessed slot (21), realized in the body of the case and which is open toward the outside by a lateral opening (22) for passage and holding of the connection cable (8). The upper wall of the body of the case (16) comprises the previously mentioned extension (5). The latter makes contact with the body of the case and extends, in flat shape, upwards to where the width and the length permit its engagement in a corresponding slide arranged on the inside of the protective headgear.

The cover (17) is constituted by a plate having the general identical shape of the body of the case (16) and comprising two holes (23, 24) a first hole (23) arranged at the level of the microphone (2) and a second hole (24) arranged at the level of the speaker (3).

In addition, there are beneficially provided two discs (200, 300) of deformable foam, arranged at the bottom of the slot (19, 20), between the microphone (2) and the bottom wall (160) of the body of the case (16) as well as between the speaker (3) and said bottom wall.

Figure 3:
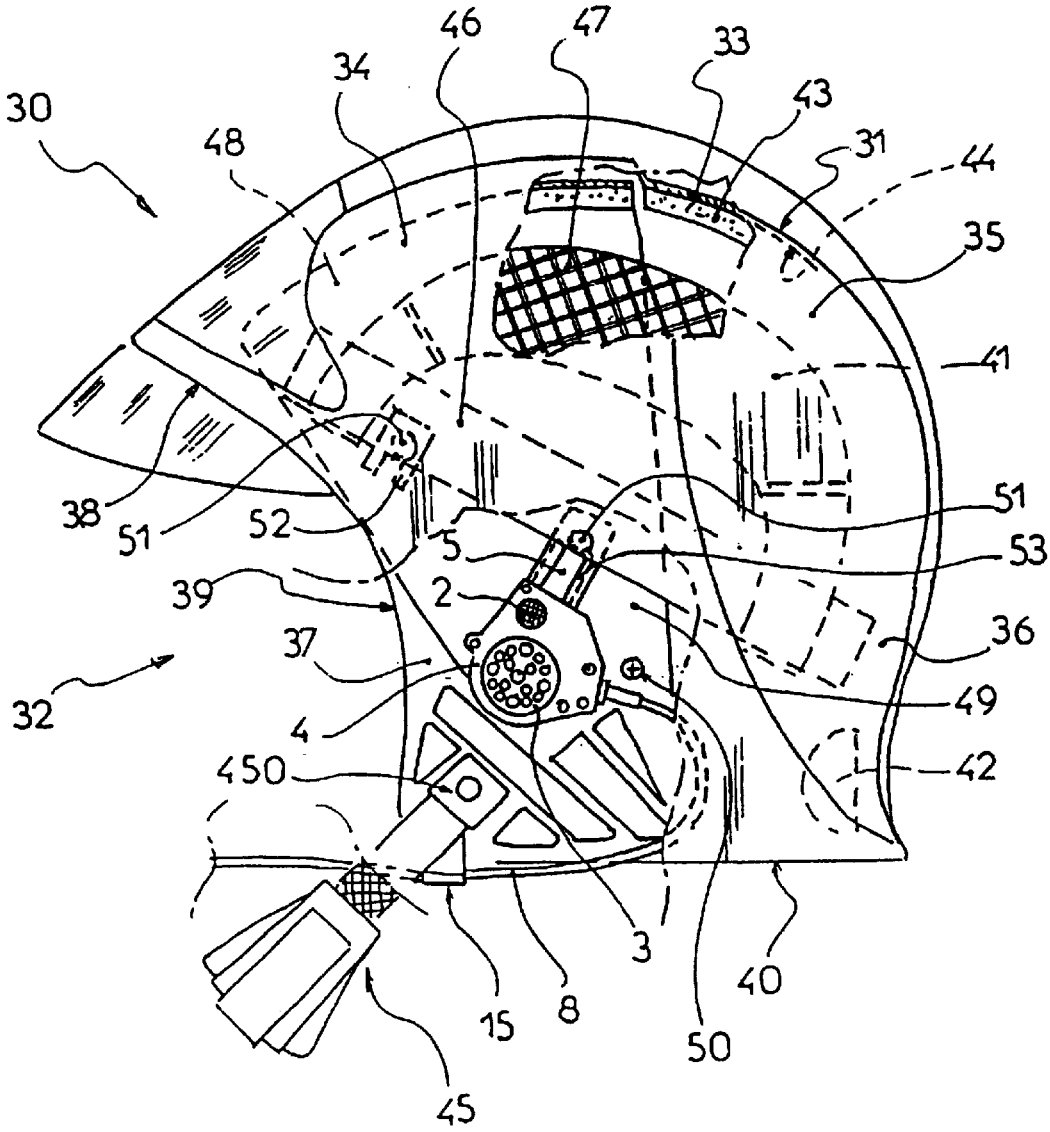
FIG. 3 is a lateral view with partial extraction of the protective headgear, equipped with the communication device according to the invention.

As seen in FIG. 3, the communication device according to the invention is integral with a protective helmet (30), which can be of any type. A headgear is thus described by way of example only, but not limited thereto, of the type which is used, for example, by firemen and comprising a principal external shell (31) protecting the skull and the nape of the neck of the user and a facial opening (32) in the zone or area occupied by the face of the user.

The shell is of rigid material and can be of any appropriate material such as plastic, steel, aluminum or composite material of the type comprising a stacking of layers of reinforcement fibers, impregnated and inter-connected by a matrix of resin. Said external shell is constituted by a slightly spherical wall (33) comprising several wall portions, namely an upper front portion (34), prolonged towards the rear by an upper rear wall portion (35), with the latter being itself prolonged toward the bottom by a lower rear wall portion (36) and comprising, in addition, two lateral wall portions (37). The front upper portion (34) corresponds to the zone occupied by the face of the user and is limited by the upper edge (38) of the facial opening (32) which, relative thereto, is laterally limited by two lateral edges (39). The upper rear wall portion (35) corresponds to the zone or area occupied by the skull of the user, while the lower rear portion of the wall (36) corresponds to the zone or area occupied by the nape of the neck of the user.

It should be added that the wall (33) of the body is limited toward the bottom by a lower edge (40). The lateral wall portions (37) correspond to the zones or area occupied by the ears of the user and are limited towards the front by the lateral edge (39) corresponding to the facial opening (32) and toward the bottom by the front ends of the lower edge (40). The exterior shell (31) constitutes a cavity comprising, for example, a lining (41) and other elements, such as, for example, the bolsters for the nape of the neck (42) as well as a circular patch (43). The latter is constituted, for example, by a layer of foam, which is, for example, glued on the inner surface (44) of the shell. The deformable cap (41) permits, on the one hand, adaptation of the headgear to the volume and shape of the head of the user, and, on the other hand, the maintenance of a space between the head and the inner surface of the shell, and comprises, in addition and in a manner known per se, a chin strap (45).

Figure 6:
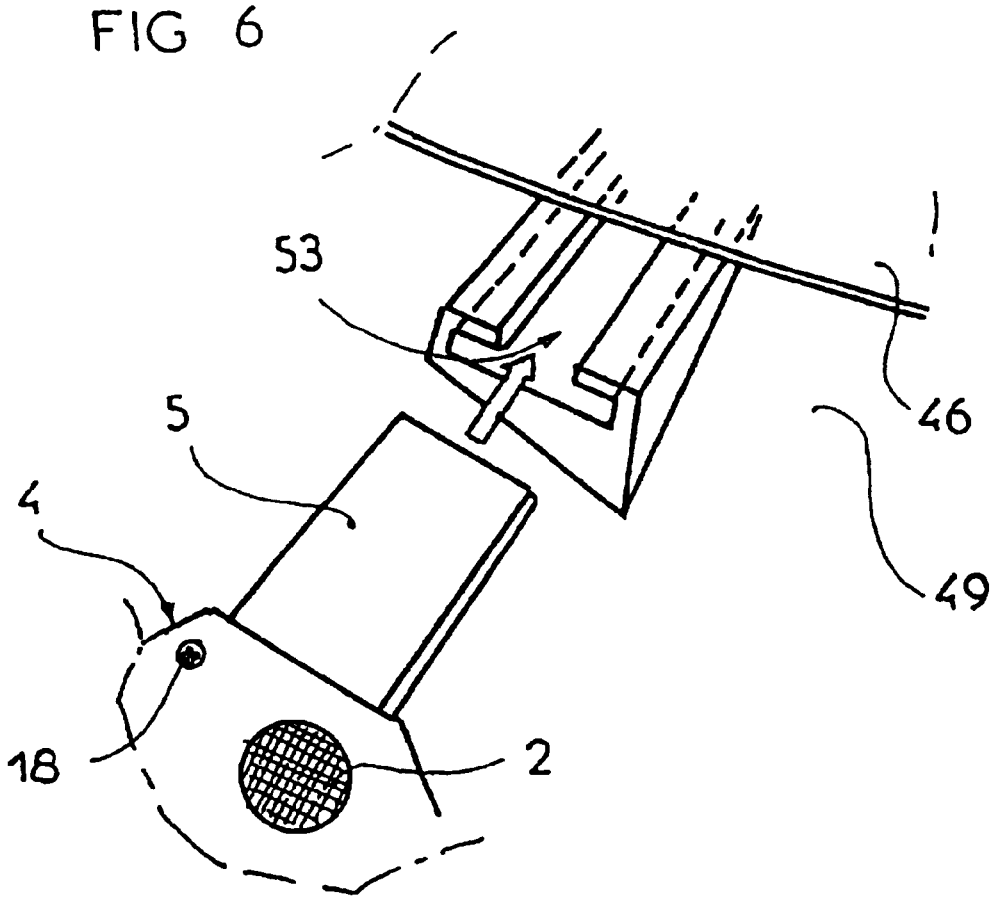

The deformable lining (41) is composed of a padded headband around the head (46) and a deformable partition (47) as, for example, a textile netting, destined-to be supported by the user's head. The lining is fixed on the inside of the headgear by its headband on a front support piece (48) arranged and fixed on the inside of the shell so that it extends from the front and partially toward the back while following the profile of the interior surface of the wall of the shell. The frontal support piece (48) is constituted by a curved wall of plastic material whose front portion extends partially in upward direction and whose ends of the lateral portions (49) are fixed to the lateral portions of the walls (37) of the shell, for example by screws (50) or similar. The fixation of the headband (46) on the front piece is effected thanks to buttons (51) which project from the band in order to be engaged and retained within corresponding obscure slides (52, 53) realized in the frontal piece (48). The two frontal slides (52) are of sufficient length in order to receive and correctly retain the hook-up buttons of the corresponding headband, while at least one of the lateral slides (53) is prolonged toward the bottom in order to receive the button of the corresponding band and to guarantee the hold and connection of the communication device (1) according to the invention. It should be noted that the lateral slides (53) (see also FIG. 6) are arranged on the inside of the headgear and laterally in the lateral zones occupied by the ears of the user of the headgear.

Figure 4:
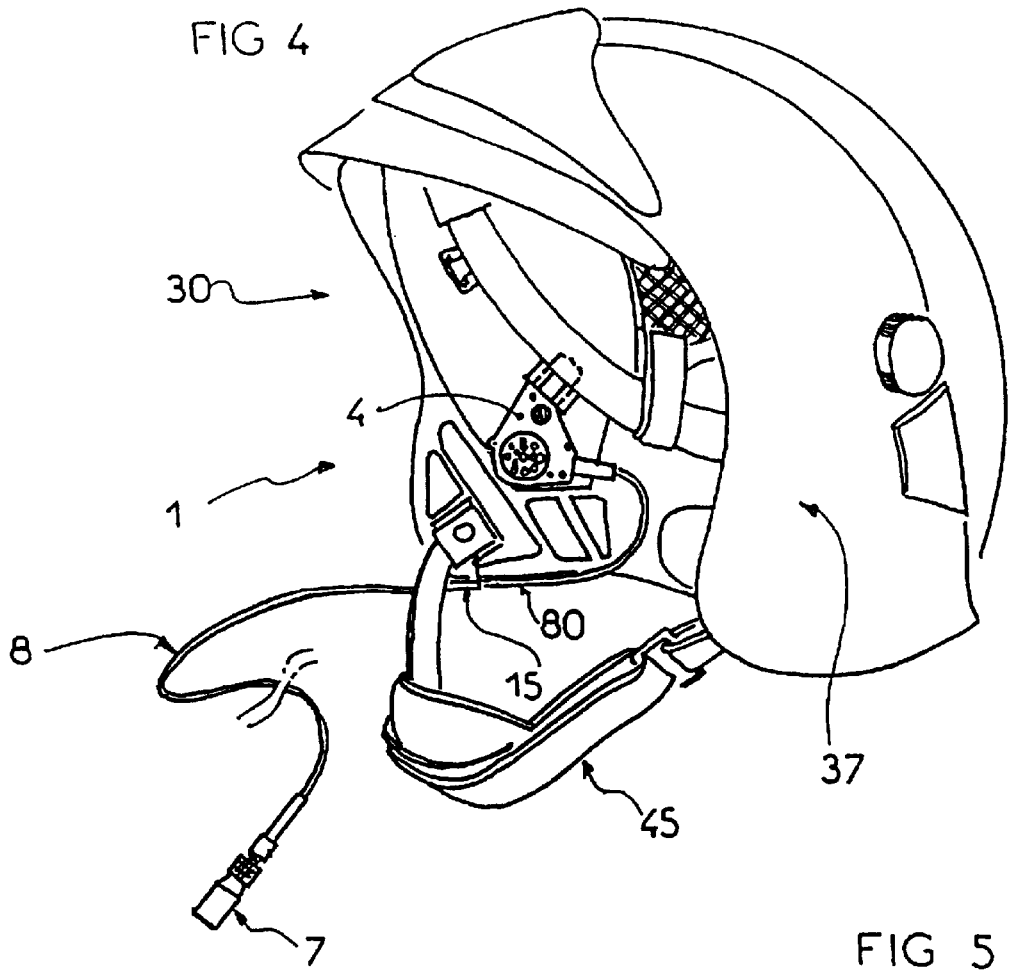
FIG. 4 is a perspective view of the headgear with its communication device.

As seen in FIG. 4, the communication case (4) is arranged on the inside of the headgear against the lateral wall portions (37) of the shell in the zone occupied by the ear of the wearer of the headgear. To that end, said case (4) is retained in the headgear by cooperation of its connection tab (5) with the lateral slide (53) as is, for example illustrated with respect to the right lateral slide. Also, the extension of the case (5) is engaged in the slide.

When in "on" position inside the headgear, the microphone sensor (2) is positioned above the receiver (3).

Figure 5:
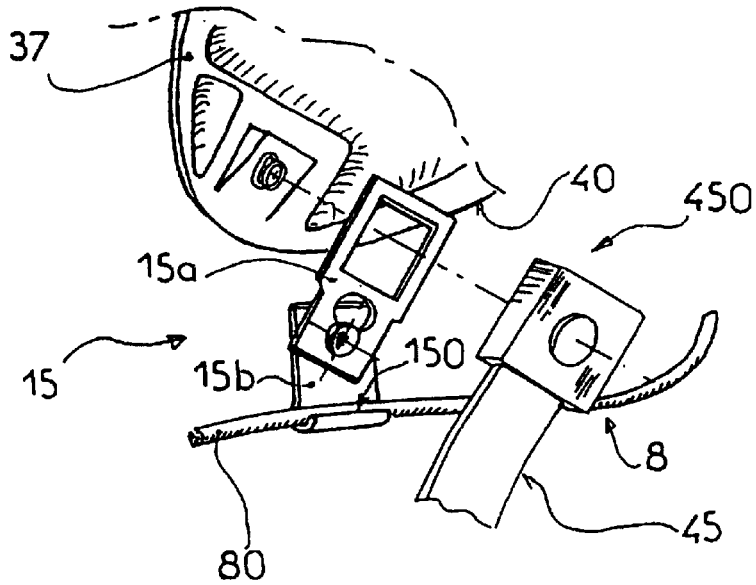
FIG. 5 is a detail view in perspective, depicting more specifically the retention of the connection cable.

Furthermore, as seen in FIG. 5, the connection cable (8) is connected with the headgear in its center portion (80) thanks to the hook-up device (15) destined to engage with the hook-up means (450) of the chin-strap (45). The hook-up device (15) comprises a first piece (15*a*) on which a second piece (5*b*) is articulated, which comprises an engagement groove (150) in which the connection cable (8, 80) is engaged. Thus, the latter extends along the lower edge (40) before jutting out towards the front (AV).

It is also contemplated that there can be other types of protective headgear employed. Furthermore, the case (4) was not at the headgear, but on the outside, as for example on its exterior wall (33) at the level of the lateral wall portions, at the level of the zones of areas occupied by the ears. Finally one can utilize all other means of connection, other than described in the preceding, such as, for example, by gluing, screw attachment etc.

It should be noted that the connection means of the case are means constituting a removable connection permitting easy installation and removal by hand, which the user can execute without the necessity of a special tool.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

What is claimed is:

1. A protective headgear equipped with an electroacoustic communication device comprising:

a case including:

an acoustic pick-up, and a speaker;

an integral external principle shell made of rigid material including two lateral wall portions covering and corresponding to zones occupied by ears of a user; and connection means to removably attach and position said case inside of said principle shell in one of the zones occupied by the ear of the user, the connection means including:

a removable connection between the case of the communication device and the external principle shell.

2. A protective headgear comprising:

a case including an extension that defines a connection tab which is configured for engagement in a lateral guide of complementary shape;

an electroacoustic type communication device including an acoustic pick-up and a speaker housed in the case;

an external principle shell including two lateral wall portions covering and corresponding to zones occupied by ears of a user, at least one of the lateral wall portions carrying the lateral guide configured for engagement with the connection tab; and, connection means to attach and position said case, acoustic pick-up, and speaker inside of said lateral wall portion and covering one of the zones occupied by the ear of the user, the connection means including the connection tab and the lateral guide which provide a removable connection between the case of the communication device and the headgear.

3. The protective headgear equipped with an electroacoustic type communication device according to claim 2, wherein the lateral guide is integral with a support piece attached to the external shell of said headgear.

4. The protective headgear equipped with an electroacoustic type communication device according to claim 3, wherein the headgear includes:

a deformable lining comprising a headband retaining a deformable partition, said headband being fixed to the headgear by the lateral guide which holds the communication device.

5. A protective headgear equipped with an electroacoustic type communication device comprising:

a rigid external principle shell which is shaped to conform with a user's head and having integral lateral rigid wall portions which define ear protection zones that cover ears of an associated user;

a case detachably attached inside of the rigid principle shell within the one of the ear zones;

a speaker disposed inside the case within the ear zone; and an acoustic pick-up disposed inside the case within the ear zone.

6. A protective headgear equipped with an electroacoustic type communication device comprising:

an external principle shell which is shaped to conform with a user's head and having lateral wall portions which define ear zones that cover ears of an associated user;

a case detachably attached inside of the headgear within the one of the ear zones;

a speaker disposed inside the case within the ear zone;

an acoustic pick-up disposed inside the case within the ear zone;

a chin-strap having an attachment means; and a connection cable connected to the case and retained at the headgear in its center portion by an attachment device which is configured to interconnect with the attachment means of the chin-strap.

7. The protective headgear equipped with an electroacoustic type communication device according to claim 5, wherein the case comprises:

two slots, a first cylindrical slot for receiving the acoustic pick-up and a second cylindrical slot for receiving the speaker.

8. The protective headgear equipped with an electroacoustic type communication device according to claim 7, wherein the acoustic pick-up is located above the speaker.

9. A protective headgear comprising:

a shell having an interior and an exterior;

a deformable structure mounted to the shell interior for supporting the shell on a user's head, the deformable structure and the shell defining ear receiving areas;

at least one tab receiving guide mounted to the interior of the shell adjacent one of the ear receiving areas;

a case having a tab which is selectively engagable with the guide for removably mounting the case to the shell adjacent the ear receiving areas;

a microphone/speaker assembly mounted in the case; and a transmitter/receiver assembly electrically connected with the microphone/speaker assembly.

10. The protective headgear according to claim 9 further including:

a chin strap connected with the shell;

an electrical cable connected between the transmitter/receiver assembly and microphone/speaker assembly;

a cable guide which is (i) releasably interconnected to an intermediate portion of the electrical cable and (ii) releasably attached to the chin strap.

* * * * *